US008749467B2

(12) United States Patent
Lee et al.

(10) Patent No.: US 8,749,467 B2
(45) Date of Patent: Jun. 10, 2014

(54) LIQUID CRYSTAL DISPLAY DEVICE USING DIFFERENT METHODS ACCORDING TO TYPE OF IMAGE SIGNALS AND METHOD OF DRIVING THE SAME

(75) Inventors: Song-Jae Lee, Gimpo-si (KR); Young-Ho Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 966 days.

(21) Appl. No.: 12/838,651

(22) Filed: Jul. 19, 2010

(65) Prior Publication Data

US 2011/0141153 A1 Jun. 16, 2011

(30) Foreign Application Priority Data

Dec. 11, 2009 (KR) ..... 10-2009-0123496

(51) Int. Cl.
*G09G 3/36* (2006.01)

(52) U.S. Cl.
USPC ..... 345/99

(58) Field of Classification Search
USPC ..... 345/99, 96
See application file for complete search history.

(56) References Cited

U.S. PATENT DOCUMENTS

| | | | | |
|---|---|---|---|---|
| 5,748,167 | A * | 5/1998 | Watanabe et al. | 345/98 |
| 6,680,722 | B1 * | 1/2004 | Hiraki et al. | 345/96 |
| 2001/0004253 | A1 | 6/2001 | Fukutoku et al. | |
| 2002/0033789 | A1 * | 3/2002 | Miyata et al. | 345/89 |
| 2004/0021625 | A1 * | 2/2004 | Lee | 345/87 |
| 2006/0097967 | A1 | 5/2006 | Lee | |
| 2006/0104509 | A1 * | 5/2006 | Park et al. | 382/167 |
| 2008/0001890 | A1 | 1/2008 | Song et al. | |
| 2009/0002301 | A1 * | 1/2009 | Koo et al. | 345/89 |
| 2009/0002302 | A1 * | 1/2009 | Koo et al. | 345/89 |
| 2009/0102771 | A1 * | 4/2009 | Sugisawa et al. | 345/89 |
| 2009/0251451 | A1 | 10/2009 | Cha et al. | |
| 2009/0316987 | A1 * | 12/2009 | Ouyang | 382/172 |
| 2010/0134533 | A1 * | 6/2010 | Moon et al. | 345/690 |
| 2011/0018891 | A1 * | 1/2011 | Peng et al. | 345/589 |

FOREIGN PATENT DOCUMENTS

| | | | |
|---|---|---|---|
| KR | 10-2001-0062355 | A | 7/2001 |
| KR | 10-2004-0001688 | A | 1/2004 |
| KR | 10-2008-0002624 | A | 1/2008 |
| KR | 10-2008-0109989 | A | 12/2008 |

* cited by examiner

*Primary Examiner* — Chanh Nguyen
*Assistant Examiner* — Robert Stone
(74) *Attorney, Agent, or Firm* — Mckenna, Long & Aldridge LLP

(57) ABSTRACT

A liquid crystal display device includes: a liquid crystal panel that displays images using a plurality of pixels each including red, green and blue sub-pixels; a gate driving portion that supplies a gate signal to the liquid crystal panel; a data driving portion that supplies a data signal to the liquid crystal panel; and a timing control portion that compares difference of gray level between image signals corresponding to the red, green and blue sub-pixels with a first threshold value and compares difference of gray level between the image signals corresponding to the red, green and blue sub-pixels of neighboring pixels of the plurality of pixels in order to judge type of the image signals, and drives the data driving portion in different methods according to the type of the image signals.

6 Claims, 5 Drawing Sheets

| | white | | | black | | | white | | | black | | |
|---|---|---|---|---|---|---|---|---|---|---|---|---|
| | R1 | G1 | B1 | R2 | G2 | B2 | R3 | G3 | B3 | R4 | G4 | B4 |
| HLm | + | − | + | − | + | − | + | − | + | − | + | − |
| HLm+1 | − | + | − | + | − | + | − | + | − | + | − | + |
| | + | − | + | − | + | − | + | − | + | − | + | − |
| | − | + | − | + | − | + | − | + | − | + | − | + |

FIG. 5A

| gray level | digital code |
|---|---|
| 255 | 11111111 |
| 254 | 11111110 |
| 253 | 11111101 |
| 252 | 11111100 |
| 251 | 11111011 |
| 250 | 11111010 |
| 249 | 11111001 |
| 248 | 11111000 |
| 247 | 11110111 |
| 246 | 11110110 |
| 245 | 11110101 |
| 244 | 11110100 |
| 243 | 11110011 |
| 242 | 11110010 |
| 241 | 11110001 |
| 240 | 11110000 |
| 239 | 11101111 |
| 238 | 11101110 |
| 237 | 11101101 |
| 236 | 11101100 |
| 235 | 11101011 |
| 234 | 11101010 |
| 233 | 11101001 |
| 232 | 11101000 |
| 231 | 11100111 |
| 230 | 11100110 |
| 229 | 11100101 |
| 228 | 11100100 |
| 227 | 11100011 |
| 226 | 11100010 |
| 225 | 11100001 |
| 224 | 11100000 |
| 223 | 11011111 |
| 222 | 11011110 |
| 221 | 11011101 |
| | ⋮ |

judged to be the same gray level in pattern recognition upper 4 bits lower 4 bits

FIG. 5B

| gray level | digital code | |
|---|---|---|
| 1023 | 111111 | 1111 |
| 1022 | 111111 | 1110 |
| 1021 | 111111 | 1101 |
| 1020 | 111111 | 1100 |
| 1019 | 111111 | 1011 |
| 1018 | 111111 | 1010 |
| 1017 | 111111 | 1001 |
| 1016 | 111111 | 1000 |
| 1015 | 111111 | 0111 |
| 1014 | 111111 | 0110 |
| 1013 | 111111 | 0101 |
| 1012 | 111111 | 0100 |
| 1011 | 111111 | 0011 |
| 1010 | 111111 | 0010 |
| 1009 | 111111 | 0001 |
| 1008 | 111111 | 0000 |
| ... | ... | ... |
| 912 | 110001 | 0000 |
| 911 | 110000 | 1111 |
| 910 | 110000 | 1110 |
| 909 | 110000 | 1101 |
| 908 | 110000 | 1100 |
| 907 | 110000 | 1011 |
| 906 | 110000 | 1010 |
| 905 | 110000 | 1001 |
| 904 | 110000 | 1000 |
| 903 | 110000 | 0111 |
| 902 | 110000 | 0110 |
| 901 | 110000 | 0101 |
| 900 | 110000 | 0100 |
| 899 | 111000 | 0011 |
| 898 | 111000 | 0010 |
| 897 | 111000 | 0001 |
| 896 | 111000 | 0000 |
| 895 | 110111 | 1111 |
| 894 | 110111 | 1110 |
| 893 | 110111 | 1101 |
| 892 | 110111 | 1100 |
| 891 | 110111 | 1011 |
| 890 | 110111 | 1010 |
| 889 | 110111 | 1001 |
| 888 | 110111 | 1000 |
| 887 | 110111 | 0111 |
| | ⋮ | |

judged to be the same gray level in pattern recognition upper 6 bits lower 4 bits

LIQUID CRYSTAL DISPLAY DEVICE USING DIFFERENT METHODS ACCORDING TO TYPE OF IMAGE SIGNALS AND METHOD OF DRIVING THE SAME

The present invention claims the benefit of Korean Patent Application No. 10-2009-0123496, filed in Korea on Dec. 11, 2009, which is hereby incorporated by reference for all purposes as if fully set forth herein.

BACKGROUND OF THE INVENTION

1. Field of the Invention

The present invention relates to a liquid crystal display device, and more particularly, to a liquid crystal display (LCD) device and a method of driving the same.

2. Discussion of the Related Art

Until recently, display devices have typically used cathode-ray tubes (CRTs). Presently, many efforts and studies are being made to develop various types of flat panel displays, such as liquid crystal display (LCD) devices, plasma display panels (PDPs), field emission displays, and electro-luminescence displays (ELDs), as a substitute for CRTs. Of these flat panel displays, LCD devices have many advantages, such as high resolution, light weight, thin profile, compact size, and low voltage power supply requirements.

In general, an LCD device includes two substrates that are spaced apart and face each other with a liquid crystal material interposed between the two substrates. The two substrates include electrodes that face each other such that a voltage applied between the electrodes induces an electric field across the liquid crystal material. Alignment of the liquid crystal molecules in the liquid crystal material changes in accordance with the intensity of the induced electric field into the direction of the induced electric field, thereby changing the light transmissivity of the LCD device. Thus, the LCD device displays images by varying the intensity of the induced electric field.

FIG. 1 is a circuit diagram illustrating a sub-pixel of an LCD device according to the related art.

Referring to FIG. 1, the LCD device includes a gate line GL, a data line DL, a thin film transistor T, a storage capacitor Cst and a liquid crystal capacitor Clc.

The gate and data lines GL and DL crosses each other to define a sub-pixel P, the thin film transistor T is connected to the gate and data lines GL and DL, and the storage capacitor Cst and the liquid crystal capacitor Clc are connected to the thin film transistor T.

Although not shown in the drawings, the liquid crystal capacitor Clc includes a pixel electrode connected to the thin film transistor T, a liquid crystal layer, and a common electrode, and functions to display a gray level corresponding to a data signal applied to the pixel electrode. The storage capacitor Cst stores the data signal for a frame and functions to maintain a pixel voltage Vp of the pixel electrode.

When the thin film transistor T is turned on by a gate signal supplied to the gate line GL, the data signal supplied to the data line DL is applied to the pixel electrode as the pixel voltage Vp. In other words, one electrodes of the liquid crystal capacitor Clc and the storage capacitor Cst are connected to a drain electrode of the thin film transistor T and supplied with the pixel voltage Vp corresponding to the data signal, and other electrodes of the liquid crystal capacitor Clc and the storage capacitor Cst are connected to the common electrode and supplied with a common voltage Vcom.

When the LCD device are operated for a long time, because of the same electric field induced for a long time, optical property of the liquid crystal layer is degraded, or positive or negative charges are accumulated at the liquid crystal layer near the pixel electrode and the common electrode thus the liquid crystal capacitor Clc is deteriorated and display quality degradation such as residual images is caused.

To solve the above problems, proposed is an inversion driving method of alternating polarities of a data signal by the predetermined period and preventing the charge accumulation in the liquid crystal layer.

The inversion driving method is categorized into a dot inversion method, a horizontal line inversion method, a vertical line inversion method, a frame inversion method and the like. The dot inversion method, the horizontal line inversion method, the vertical line inversion method can be used in combination with the frame inversion method.

The dot inversion method is to invert a polarity of a data signal per sub-pixel and per frame thus has the advantage of displaying images having good quality. The dot inversion method is categorized into a 1(one)-dot inversion method, a vertical 2(two)-dot inversion method, a horizontal 2(two)-dot inversion method and the like.

The horizontal line inversion method is to invert a polarity of a data signal per horizontal line and per frame. The vertical line inversion method is to invert a polarity of a data signal per vertical line and per frame.

The frame inversion method is to invert a polarity of a data signal per frame.

When displaying normal images, image display of good quality can be performed by driving the LCD device in the dot inversion method. However, when displaying an image having a specific pattern, for example, an image having different grays arranged in stripe form, display quality degradation such as crosstalk, greenish and the like may occur.

FIG. 2 is a view illustrating a specific pattern image displayed in the LCD device according to the related art.

Referring to FIG. 2, red (R), green (G) and blue (B) sub-pixels are alternately arranged in each horizontal line, and the same color sub-pixels are arranged in each vertical line. This type LCD device may be referred to as a stripe type LCD device. The neighboring red (R), green (G) and blue (B) sub-pixels form a pixel as an image display unit.

The LCD device displays the specific pattern image, in which different grays, for example, black and white are alternately arranged in stripe form, in a dot inversion method. In this case, for a mth horizontal line HLm, a red (R1) data signal for a high gray (white) of a positive polarity (+), a green (G1) data signal for a high gray (white) of a negative polarity (−), a blue (B1) data signal for a high gray (white) of a positive polarity (+), a red (R2) data signal for a low gray (black) of a negative polarity (−), a green (G2) data signal for a low gray (black) of a positive polarity (+), a blue (B2) data signal for a low gray (black) of a negative polarity (−), and the like are inputted to the irrespectively sub-pixels. For a (m+1)th horizontal line HLm+1, a red (R1) data signal for a high gray (white) of a negative polarity (−), a green (G1) data signal for a high gray (white) of a positive polarity (+), a blue (B1) data signal for a high gray (white) of a negative polarity (−), a red (R2) data signal for a low gray (black) of a positive polarity (+), a green (G2) data signal for a low gray (black) of a negative polarity (−), a blue (B2) data signal for a low gray (black) of a positive polarity (+), and the like are inputted to the irrespectively sub-pixels.

As described above, for the mth horizontal line HLm, the data signals having a negative polarity (−) and the data signals having a positive polarity (+) are the same in number. However, the data signals of a positive polarity (+) are dominant in the high gray region displaying white while the data signals of a negative polarity (−) are dominant in the low gray region displaying black, and a voltage of the data signal for white has an absolute value more than a voltage of the data signal for black. Accordingly, the data signals of the mth horizontal line HLm have a positive polarity (+) overall.

On the contrary, for the (m+1)th horizontal line HLm+1, the data signals having a negative polarity (−) and the data signals having a positive polarity (+) are the same in number. However, the data signals of a negative polarity (−) are dominant in the high gray region displaying white while the data signals of a positive polarity (+) are dominant in the low gray region displaying black, and a voltage of the data signal for white has an absolute value more than a voltage of the data signal for black. Accordingly, the data signals in the mth horizontal line HLm+1 have a negative polarity (+) overall.

The data signal is applied to the pixel electrode as a pixel voltage, and the pixel voltage induces an electric field along with a common voltage applied to the common electrode facing the pixel electrode. According to the dominant polarity of the pixel voltages, the common voltage is shifted.

In other words, the common voltage of the mth horizontal line HLm is shifted to have a positive polarity (+) while the common voltage of the (m+1)th horizontal line HLm+1 is shifted to have a negative polarity (−).

Accordingly, with respect to the positively-shifted common voltage of the mth horizontal line HLm, a voltage difference between the green (G) data signal for the high gray (white) of a negative polarity (−) of the mth horizontal line HLm and the common voltage is greater than a voltage difference between each of the red (R) and blue (B) data signals for the high gray (white) of a positive polarity (+) and the common voltage. On the contrary, with respect to the negatively-shifted common voltage of the mth horizontal line HLm+1, a voltage difference between the green (G) data signal for the high gray (white) of a positive polarity (+) of the (m+1)th horizontal line HLm+1 and the common voltage is greater than a voltage difference between each of the red (R) or blue (B) data signal for the high gray (white) of a negative polarity (−) and the common voltage. Accordingly, the green (G) data signal for the high gray level (white) displays a gray level higher than each of the red (R) and blue (B) data signal for the high gray level (white) over the whole of the LCD device.

As described above, when the LCD device operated in a dot inversion method displays the specific pattern image, in which the different grays are alternately arranged in stripe form, the green (G) data signal has the higher gray level and the display image is greenish. Accordingly, display quality is degraded.

Further, when another specific pattern image, in which a rectangular region at center of the image and a peripheral region surrounding the rectangular region are different in gray level and different grays are arranged in stripe form in the rectangular region, is displayed, there occurs a crosstalk that an specific image in stripe form is dimly seen at a portion of the peripheral region that extends horizontally from the rectangular region. Accordingly, display quality is degraded.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a liquid crystal display device and a method of driving the same that can improve display quality.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a liquid crystal display device includes: a liquid crystal panel that displays images using a plurality of pixels each including red, green and blue sub-pixels; a gate driving portion that supplies a gate signal to the liquid crystal panel; a data driving portion that supplies a data signal to the liquid crystal panel; and a timing control portion that compares difference of gray level between image signals corresponding to the red, green and blue sub-pixels with a first threshold value and compares difference of gray level between the image signals corresponding to the red, green and blue sub-pixels of neighboring pixels of the plurality of pixels in order to judge type of the image signals, and drives the data driving portion in different methods according to the type of the image signals.

In another aspect, a method of driving a liquid crystal display device includes: comparing difference of gray level between image signals corresponding to red, green and blue sub-pixels of a pixel with a first threshold value through a timing control portion; comparing difference of gray level between the image signals corresponding to the red, green and blue sub-pixels of the pixel and a neighboring pixel through the timing control portion; judging type of the image signals through the timing control portion according to the comparison result; supplying from the timing control portion a data control signal and RGB data signals to a data driving portion and a gate control signal to a gate driving portion according to the type of the image signals; supplying from the gate and data driving portions gate and data signals, respectively, to a liquid crystal panel; and displaying an image using the gate and data signals through the liquid crystal panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 5A is a table illustrating gray level to 8-bit digital code of an image signal inputted to a sub-pixel according to the first embodiment of the present invention;

FIG. 5B is a table illustrating gray level to 10-bit digital code of an image signal inputted to a sub-pixel according to the first embodiment of the present invention.

DETAILED DESCRIPTION OF THE ILLUSTRATED EMBODIMENTS

Reference will now be made in detail to illustrated embodiments of the present invention, which are illustrated in the accompanying drawings.

Figures 1, 2:
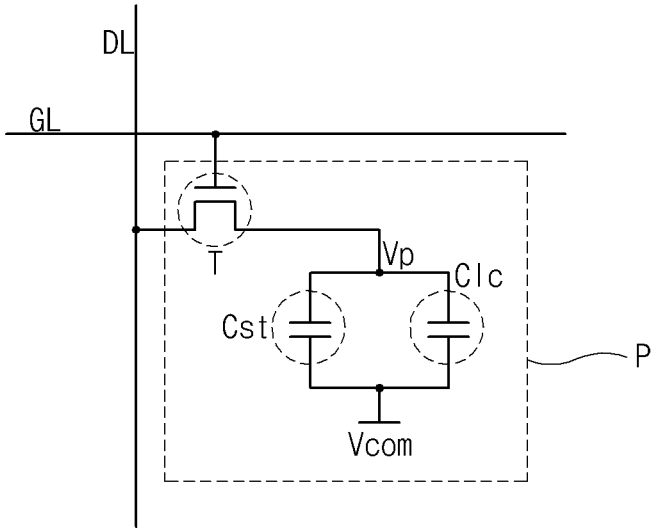
FIG. 1 RELATED ART
FIG. 2 RELATED ART
FIG. 1 is a circuit diagram illustrating a sub-pixel of an LCD device according to the related art.
FIG. 2 is a view illustrating a specific pattern image displayed in the LCD device according to the related art.
Figure 3:
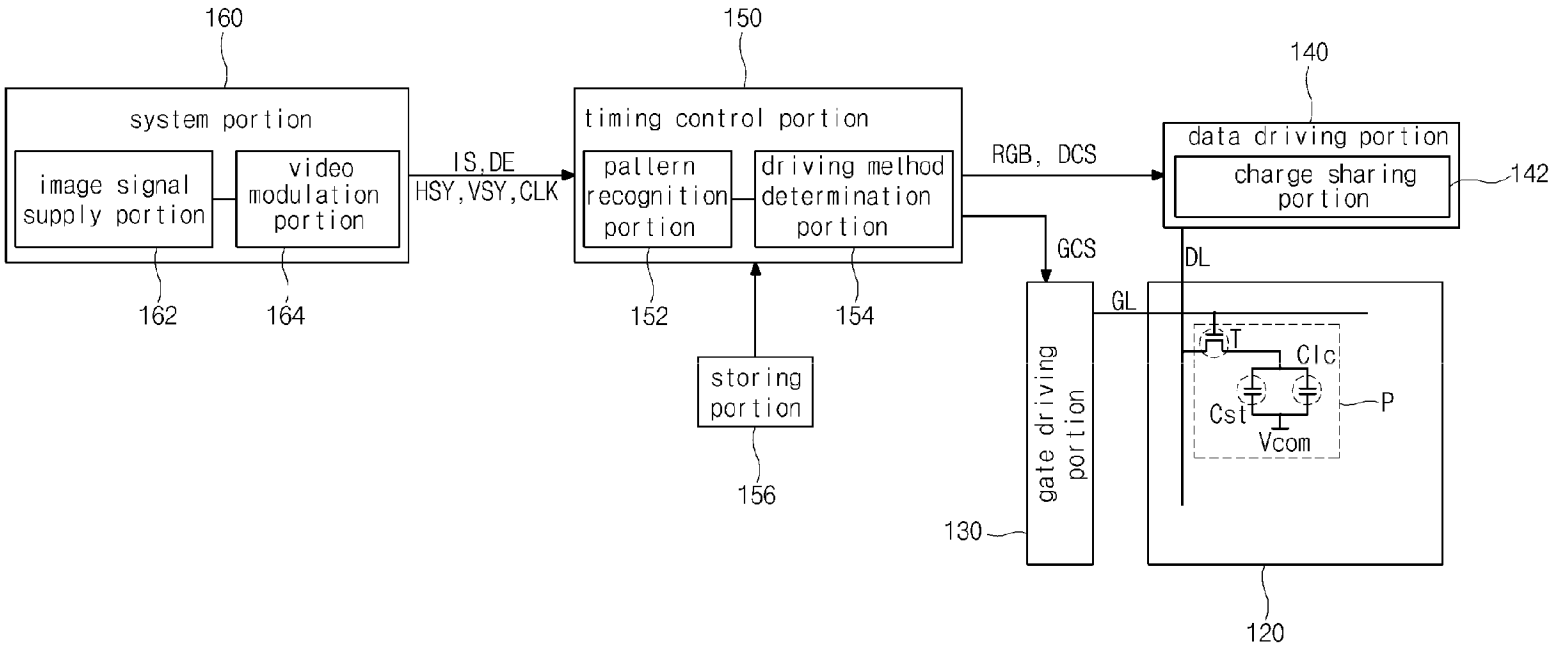
FIG. 3 is a view illustrating an LCD device according to a first embodiment of the present invention.
Figure 4:
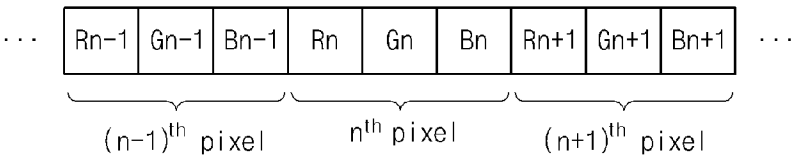
FIG. 4 is a view illustrating a pixel of the LCD device according to the first embodiment of the present invention.

FIG. 3 is a view illustrating an LCD device according to a first embodiment of the present invention, and FIG. 4 is a view illustrating a pixel of the LCD device according to the first embodiment of the present invention.

Referring to FIGS. 3 and 4, the LCD device 110 includes a liquid crystal panel 120 displaying images, a gate driving portion 130 supplying gate signals to the liquid crystal panel 120, a data driving portion 140 supplying data signals to the liquid crystal panel 120, a timing control portion 150 supplying a gate control signal GCS to the gate driving portion 130 and a data control signal DCS and RGB data signals to the data driving portion 140, and a system portion 160 supplying image signals IS and control signals to the timing control portion 150.

The liquid crystal panel 120 includes gate and data lines GL and DL crossing each other to define a sub-pixel P. In the sub-pixel P, a thin film transistor T connected to the gate and data lines GL and DL, a liquid crystal capacitor Clc and a storage capacitor Cst connected to the switching transistor T are formed.

The gate driving portion 130 sequentially outputs the gate signals to the gate lines GL. When the gate signal is supplied, the thin film transistor T is turned on and the data driving portion 140 outputs the data signal to the data line DL. The data signal is applied to one electrodes of the liquid crystal capacitor Clc and the storage capacitor Cst through the data line DL. The other electrodes of the liquid crystal capacitor Clc and the storage capacitor Cst are supplied with a common voltage Vcom.

Each of the gate and data driving portions 130 and 140 may include a printed circuit board (PCB) on which a plurality of driving integrated circuits (D-ICs) are mounted.

The data driving portion 140 may include a charge sharing portion 142. The charge sharing portion 142 performs a charge sharing operation among the data lines DL, and, to do this, may include a plurality of switches (not shown) that short/open-circuit the data lines DL.

Alternatively, the gate and data driving portions 130 and 140 may be combined together to form one driving portion, and the one driving portion may generate gate and data signals and supplies the gate and data signals to the liquid crystal panel 120. Yet alternatively, a part of the gate driving portion such as a shift register may be directly formed in the liquid crystal panel 120 and generate gate signals, the one driving portion may generate data signals, and these gate and data signals may be supplied to the liquid crystal panel 120.

The system portion 160 supplies the image signals IS, a data enable (DE) signal, horizontal synchronization (HSY) signal, a vertical synchronization (VSY) signal, a clock signal (CLK) and the like to the timing control portion 150. Using these signals, the timing control portion 150 generates the gate control signal GCS, the RGB data signals and the data control signal DCS to the corresponding gate and data driving portions 130 and 140.

In more detail, the system portion 160 may include an image signal supply portion 162 and a video modulation portion 164.

The LCD device 110 may display images, which are suitable at a frequency of 60 Hz, at a frequency of 120 or 240 Hz in order to prevent degradation of display quality such as motion blur in displaying moving images and display images more naturally. To do this, the image signal supply portion 162 supplies reference images of 60 frames per second used for a driving at 60 Hz, and the video modulation portion 164 generates virtual images of 60 or 180 frames and appropriately inserts the virtual images among the reference images of 60 frames. Accordingly, image signals for 120 Hz or 240 Hz are outputted from the video modulation portion 164.

The video modulation portion 164 may be manufactured in a type of a video IC of a television (TV) or computer, a type of a MEMC (motion estimation/motion conversion) IC, a type of a FRC (frame rate conversion chip) IC, or the like.

The timing control portion 150 may include a pattern recognition portion 152 and a driving method determination portion 154.

To prevent degradation of display quality in displaying a specific pattern image, for example, an image in which different grays are arranged in stripe form, the LCD device 110 analyzes image signals and judges whether or not an image has a specific pattern. When an image is not the specific pattern image, the LCD device 110 displays the image in a dot inversion method and the like. When the image is the specific pattern image, the LCD device 110 displays the image in a vertical line inversion method, a horizontal line inversion method or the like, and in order to minimize variation of a common voltage, after displaying a previous image and before displaying a current image, performed may be a charge sharing that substantially completely discharges charges remaining in the liquid crystal panel 120. To do this, the pattern recognition portion 152 analyzes image signals of each frame from the system portion 160. The driving method determination portion 154 determines a driving method of the LCD device 110 according to the analysis result of the pattern recognition portion 152. For example, the driving method determination portion 154 determines a dot inversion method as the driving method, which may be a normal driving method of the data driving portion 140, when the analysis result indicates that a frame image is not the specific pattern image. The driving method determination portion 154 determines a vertical or horizontal inversion method as the driving method, which may be other driving method stored in a storing portion 156, when the analysis result indicates that the frame image is the specific pattern image. Further, the driving method determination portion 154 may determine if the charge sharing portion 142 is performed according to the analysis result of the pattern recognition portion 152.

In judging the specific pattern image, the pattern recognition portion 152 may firstly judge if gray levels among sub-pixels of a pixel are the same in order to judge if the pixel displays gray, and secondly judge if the same color sub-pixels between neighboring pixels have the same gray level in order to judge if the neighboring pixels display different gray levels.

For example, referring to FIG. 4, the pattern recognition portion 154 judges that an image is a specific pattern image when sub-pixels and pixels meet following first and second conditions:

[gray level of ($Rn-1$)=gray level of ($Gn-1$)=gray level of ($Bn-1$)] & [gray level of ($Rn$)=gray level of ($Gn$)=gray level of ($Bn$)]; and The first condition (cond. 1):

[gray level of $(Rn-1)\neq$gray level of $(Rn)$] & [gray level of $(Gn-1)\neq$gray level of $(Gn)$] & [gray level of $(Bn-1)\neq$gray level of $(Bn)$]. The second condition (cond. 1):

The first condition (cond. 1) means that the specific pattern is recognized when the red (R), green (B) and blue (B) sub-pixels in each pixel have the same gray level, and the second condition (cond. 2) means that the specific pattern is recognized when each of the red (R), green (B) and blue (B) sub-pixels between the neighboring pixels have the different gray levels.

In applying the first and second conditions (conds. 1 and 2) for the pattern recognition, a gray level of each sub-pixel corresponds to a 8 or 10-bit digital code, and the first and second conditions are applied with respect to upper 4 or 6 bits except for lower 4 bits among the 8 or 10 bits. This is explained in more detail further with reference to FIGS. 5A and 5B.

FIG. 5A is a table illustrating gray level to 8-bit digital code of an image signal inputted to a sub-pixel according to the first embodiment of the present invention, and FIG. 5B is a table illustrating gray level to 10-bit digital code of an image signal inputted to a sub-pixel according to the first embodiment of the present invention.

Referring to FIGS. 5A and 5B, for the pattern recognition, the LCD device 110 disregards the lower 4 bits of the 8 or 10-bit digital code (e.g., replaces the lower 4 bits with "0"), and checks that the first and second conditions (conds. 1 and 2) are met with respect to the upper 4 or 6 bits.

For example, in the pattern recognition step, 16 gray levels of the $224^{th}$ to $239^{th}$ gray levels in FIG. 5A are judged to be the same, and 16 gray levels of the $896^{th}$ to $911^{st}$ gray levels in FIG. 5B are judged to be the same.

The disregard for the lower 4 bits is for preventing errors that occur in the pattern recognition step when gray levels in a specific pattern change somewhat due to noise in the image signal modulation step of the video modulation portion 164 before the pattern recognition step.

When the image signal supply portion 152 supplies a specific pattern image in which each of the gray levels of the Rn, Gn and Bn is, for example, the $910^{th}$ gray level (i.e., "1100001110" in digital code) of FIG. 5B, the image, in which the gray levels of the Rn, Gn and Bn change into the $910^{th}$ gray level (i.e., "1100001110" in digital code), the $909^{th}$ gray level (i.e., "1100001101" in digital code) and the $911^{st}$ gray level (i.e., "1100001111" in digital code), respectively, of FIG. 5B because of noise in the image signal modulation step of the video modulation portion 164, may be outputted from the system portion 160. In this case, if the first reference condition (cond. 1) is applied, a relation of [gray level of (Rn)≠gray level of (Gn)≠gray level of (Bn)] is obtained and thus it is judged that the image is not the specific pattern image. In other words, the specific pattern recognition may be not performed normally. This causes an error that the pattern recognition portion 152 does not normally recognize the specific pattern, and the specific pattern image is displayed in a dot inversion method and the like, and thus degradation of display quality such as crosstalk and greenish occurs. To prevent this, the pattern recognition portion 152 uses the first condition (cond. 1) for the upper 4 or 6 bits except for the lower 4 bits instead of all bits of the 8 or 10-bit digital code.

For example, even when the gray levels of the Rn, Gn and Bn change into the $910^{th}$ gray level (i.e., "1100001110" in digital code), the $909^{th}$ gray level (i.e., "1100001101" in digital code) and the $911^{st}$ gray level (i.e., "1100001111" in digital code), respectively, of FIG. 5B because of noise of the video modulation portion 164, the first condition (cond. 1) is applied for the upper 6 bits of the Rn, Gn and Bn. Accordingly, a relation of [gray level of (Rn)=gray level of (Gn) =gray level of (Bn)] is obtained, and the pattern recognition portion 152 can thus recognize that the image is the specific pattern image.

In other words, even though the change of gray level in the video modulation portion 164 occurs due to noise, the pattern recognition portion 152 normally judges the specific pattern. Accordingly, the specific pattern in a vertical or horizontal line inversion method can be displayed and the charge sharing can be determined, and thus degradation of display quality such as crosstalk and greenish can be prevented.

However, applying the first and second conditions (conds. 1 and 2) for the upper 4 or 6 bits, as described above, may cause other error. When the image signal supply portion 152 supplies a specific pattern image, for example, an image in which each of the gray levels of the Rn, Gn and Bn is, for example, the $910^{th}$ gray level ("1100001110 in digital code) of FIG. 5B, the gray levels of the Rn, Gn and Bn may change into the $910^{th}$ gray level (i.e., "1100001110" in digital code), the $909^{th}$ gray level (i.e., "1100001101" in digital code) and the $912^{nd}$ gray level (i.e., "1100010000" in digital code), respectively, of FIG. 5B because of noise in the image signal modulation step of the video modulation portion 164. In this case, due to the noise, the gray level changes by two gray levels at most. However, since the first condition (cond. 1) is applied for the upper 6 bits i.e., "110000", "110000" and "110001", a relation of [gray level of (Rn)≠gray level of (Gn)≠gray level of (Bn)] is made. Accordingly, the pattern recognition portion 152 judges that the image is not the specific pattern image, and the specific pattern image is thus operated in a dot inversion method and the like. Accordingly, degradation of display quality such as crosstalk and greenish may be caused.

To solve this, suggested is a second embodiment that uses other conditions and prevents the degradation of display quality.

Figure 6:
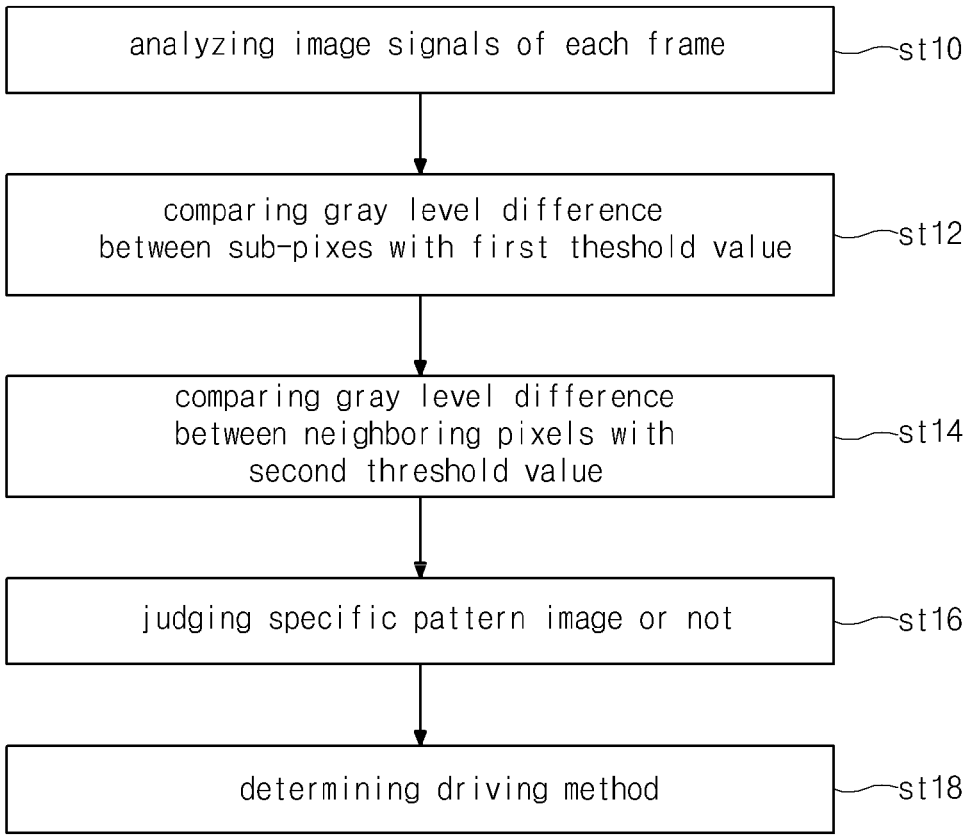
FIG. 6 is a view illustrating pattern recognition and driving method determination steps of a timing control portion in a method of driving an LCD device according to a second embodiment of the present invention.

FIG. 6 is a view illustrating pattern recognition and driving method determination steps of a timing control portion in a method of driving an LCD device according to a second embodiment of the present invention. The LCD device of the second embodiment is similar to that of the first embodiment. For example, the LCD device of the second embodiment has substantially the same components as that of the first embodiment, and uses the same digital code as that of the first embodiment. Accordingly, further with reference to FIGS. 3 to 5, the LCD device and a method of driving the same according to the second embodiment may be explained as follows.

In the LCD device of the second embodiment, the image signal supply portion 162 of the system portion 160 supplies image signals for 60 Hz, and the video modulation portion 164 of the system portion 160 adds virtual images into reference images corresponding to the image signals for 60 Hz and thus finally outputs images for 180 or 240 Hz to the timing control portion 150.

Referring to FIG. 6, the pattern recognition portion 152 of the timing control portion 150 analyzes image signals of each frame (st10), and judges if the frame image is a specific pattern image, for example, an image in which different grays are arranged in stripe form.

In more detail, the pattern recognition portion 152 judges if sub-pixels of a pixel are the same in gray level by comparing a gray level difference between the sub-pixels with a first threshold value in order to judge if the pixel displays gray (st12). Then, the pattern recognition portion 152 judges if gray levels of the same color between neighboring pixels are different by comparing a gray level difference between the neighboring pixels with a second threshold value in order to judge if the neighboring pixels are different in gray (st14).

Accordingly, the pattern recognition portion 152 judges that the frame image is the specific pattern image when the sub-pixels and the pixels of FIG. 4 meet following third and fourth conditions while the pattern recognition portion 152 judges that the frame image is not the specific pattern image when the sub-pixels and the pixels of FIG. 4 does not meet the third and fourth conditions.

The third and fourth conditions are as follows:

[|gray level of (*Rn*)−gray level of (*Gn*)|≤first threshold value] & [|gray level of (*Gn*)−gray level of (*Bn*)|≤first threshold value] & [|gray level of (*Bn*)−gray level of (*Rn*)|≤first threshold value]. Third condition (cond. 3):

[|gray level of (*Rn*−1)−gray level of (*Rn*)|≥second threshold value] & [|gray level of (*Gn*−1)−gray level of (*Gn*)|≥second threshold value] & [|gray level of (*Bn*−1)−gray level of (*Bn*)|≥second threshold value]. Fourth condition (cond. 4):

In other words, the pattern recognition portion 152 judges that the specific pattern image is recognized when the third and fourth conditions (conds. 3 and 4) are met while the pattern recognition portion 152 judges that the specific pattern image is not recognized when the third and fourth conditions (conds. 3 and 4) are not met (st16).

The driving method determination portion 154 determines a driving method according to the analysis result of the pattern recognition portion 152 (st18).

In other words, when the pattern recognition portion 152 recognizes the specific pattern, the frame image is displayed in a dot inversion method as a normal driving method. When the pattern recognition portion 152 does not recognize the specific pattern, the frame image is displayed in a driving method stored in the storing portion 156, for example, a horizontal or vertical line inversion method. Further, whether or not the charge sharing is performed is determined.

In the above conditions, the third condition (cond. 3) is a pattern recognition condition for the case that red (R), green (G) and blue (B) sub-pixels of one pixel are the same in gray level, and this means that the specific pattern is recognized when the gray level difference between the sub-pixels is equal to or less than the first threshold value. Further, the fourth condition (cond. 4) is a pattern recognition condition for the case that each of the red (R), green (G) and blue (B) sub-pixels between the neighboring pixels are different in gray level, and this means that the specific pattern is recognized when the gray level difference between the sub-pixels of the neighboring pixels is equal to or more than the second threshold value.

The first and second threshold values may be determined under a condition that substantially does not cause degradation of display quality.

The above third and fourth conditions (conds. 3 and 4) may be applied for the upper 8 bits of the 8 or 10-bit digital code.

For example, when each of the first and second threshold values is set to a value corresponding to 4 gray levels ("11" in digital code), neighboring 4 gray levels of FIG. 5A, for example, the $236^{th}$ gray level to the $239^{th}$ gray level are judged to be the same in gray level, and 16 gray levels of FIG. 5B, for example, the $896^{th}$ gray level to the $911^{st}$ gray level are the same in gray level.

Accordingly, even when gray levels of a specific pattern change due to noise in the image signal modulation step of the video modulation portion 164, the pattern recognition portion 152 can normally recognize the specific pattern.

In more detail, when the image signal supply portion 154 supplies a specific pattern image in which each of gray levels of Rn, Gn and Bn is the $910^{th}$ gray level ("1100001110" in digital code) of FIG. 5B, the gray levels of the Rn, Gn and Bn change into the $910^{th}$ gray level (i.e., "1100001110" in digital code), the $909^{th}$ gray level (i.e., "1100001101" in digital code) and the $911^{st}$ gray level (i.e., "1100001111" in digital code), respectively, of FIG. 5B because of noise in the image signal modulation step of the video modulation portion 164. In this case, the pattern recognition portion 154 applies the third condition (cond. 3) for the upper 8 bits of the Rn, Gn and Bn i.e., "11000011", "11000011" and "11000011", a relation of [|gray level of (Rn)−gray level of (Gn)|="00"≤first threshold value="11"] & [|gray level of (Gn)−gray level of (Bn)|="00"≤first threshold value="11"] & [|gray level of (Bn)−gray level of (Rn)|="00"≤first threshold value="11"] is made. Accordingly, the pattern recognition portion 152 judges that an image to be displayed is the specific pattern image. Thus, the driving method determination portion 154 determines a horizontal or vertical line inversion method as a driving method, determines whether or not a charge sharing is performed, and then supplies to the data driving portion 140 the data control signal DCS corresponding to the determination of the driving method determination portion 154. Therefore, degradation of display quality such as crosstalk and greenish can be prevented.

Further, when the image signal supply portion 154 supplies a specific pattern image in which each of gray levels of Rn, Gn and Bn is the $910^{th}$ gray level ("1100001110" in digital code) of FIG. 5B, the gray levels of the Rn, Gn and Bn change into the $910^{th}$ gray level (i.e., "1100001110" in digital code), the $909^{th}$ gray level (i.e., "1100001101" in digital code) and the $912^{nd}$ gray level (i.e., "1100010000" in digital code), respectively, of FIG. 5B because of noise in the image signal modulation step of the video modulation portion 164. Even in this case, the pattern recognition portion 154 applies the third condition (cond. 3) for the upper 8 bits of the Rn, Gn and Bn i.e., "11000011", "11000011" and "11000100", and thus a relation of [|gray level of (Rn)−gray level of (Gn)|="00"≤first threshold value="11"] & [|gray level of (Gn)−gray level of (Bn)|="01"≤first threshold value="11"] & [|gray level of (Bn)−gray level of (Rn)|="01"≤first threshold value="11"] is made. Accordingly, the pattern recognition portion 152 judges that an image to be displayed is the specific pattern image. Thus, the driving method determination portion 154 determines a horizontal or vertical line inversion method as a driving method, determines whether or not a charge sharing is performed, and then supplies to the data driving portion 140 the data control signal DCS corresponding to the determination of the driving method determination portion 154. Therefore, degradation of display quality such as crosstalk and greenish can be prevented.

This is obtained by increasing a number of bits, which are used for the comparison, to 8, and setting the first and second threshold values as margins for the comparison.

The comparison of the gray level difference between the sub-pixels of the pixel with the first threshold value, as described above, can be applied, in the same manner, to the comparison of the gray level difference between the sub-pixels of the neighboring pixels with the second threshold value.

After the driving method is determined through the driving method determination portion 154, the timing control portion 150 supplies the gate control signal GCS, and the data control signal DCS and the RGB data signals to the gate driving portion 130, and data driving portions 130 and 140, respectively. The gate and data driving portions 130 and 140 supplies gate and data signals, respectively, to the liquid crystal panel 120. When the thin film transistor T is turned on by the gate signal, the data signal is applied to the pixel electrode of the liquid crystal capacitor Clc, and an image is thus displayed.

In the above second embodiment, described is an example that the upper 8 bits are used for the comparison. Alternatively, upper 6 bits may be used for the comparison, and in this case, greater first and second threshold values may be used.

In the LCD device of the second embodiment, with respect to the upper 8 bits of the 8 or 10-bit digital code, equality of gray level between the sub-pixels of the pixel is judged by comparing the gray level difference between the sub-pixels of the pixel with the predetermined first threshold value, and difference of gray level between the neighboring pixels is judged by comparing the gray level difference between the sub-pixels of the neighboring pixels with the second threshold value. Therefore, an effect on the gray level change due to noise in the system portion 160 is removed, and the specific pattern recognition can be normally performed.

The comparison result, which is used for the fourth condition, of the gray level difference between the same color sub-pixels of the neighboring pixels with the second threshold value may be used to distinguish among an image to only display red (R), an image to only display green (G), an image to only display blue (B), and an image to display red (R), green (G) and blue (B).

As described in the above embodiments, the image signals of the frame are analyzed, and the LCD device is operated in different methods according to the analysis result. Therefore, when displaying the specific pattern image, degradation of display quality such as crosstalk or greenish can be prevented. Further, since the pattern recognition conditions for image signal analysis are supplied, error in the pattern recognition is reduced and thus display quality can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel that displays images using a plurality of pixels each pixel including red, green, and blue sub-pixels;

a gate driving portion that supplies a gate signal to the liquid crystal panel;

a data driving portion that supplies a data signal to the liquid crystal panel; and a timing control portion that compares differences of gray levels between image signals corresponding to the red, green, and blue sub-pixels with a first threshold value and compares differences of gray levels between the image signals corresponding to the red, green, and blue sub-pixels of neighboring pixels of the plurality of pixels with a second threshold value in order to judge a type of the image signals, and drives the data driving portion in different methods according to the type of the image signals, wherein the timing control portion includes:

a pattern recognition portion that judges that the type of the image signals is a first or a second pattern; and a driving method determination portion that drives the data driving portion in a first or a second method according to a judgment result of the pattern recognition portion, and wherein when the red, green, and blue sub-pixels of the neighboring pixels are Rn−1, Gn−1, and Bn−1, and Rn, Gn, and Bn, respectively, and wherein the pattern recognition portion judges as the first pattern the type of the image signals that meet a first condition ([|gray level of (Rn)−gray level of (Gn)|≤first threshold value] & [|gray level of (Gn)−gray level of (Bn)|≤first threshold value] & [|gray level of (Bn)−gray level of (Rn)|≤first threshold value]), and a second condition ([|gray level of (Rn−1)−gray level of (Rn)|≥second threshold value] & [|gray level of (Gn−1)−gray level of (Gn)|≥second threshold value] & [|gray level of (Bn−1)−gray level of (Bn)|≥second threshold value]), and judges as the second pattern the type of the image signals that do not meet the first and the second conditions.

2. The device according to claim 1, wherein the image signal is represented in 8 or 10-bit digital code, and the timing control portion compares the differences of gray level with respect to upper 6 or 8 bits of the image signal with the respective first and second threshold values.

3. The device according to claim 1, wherein the first pattern is a gray pattern in which different grays are arranged in stripe form, wherein the first method is a horizontal or vertical line inversion method, and the second driving method is a dot inversion method, and wherein whether or not a charge sharing is performed is determined according to the judgment result of the pattern recognition portion.

4. The device according to claim 3, further comprising:

a system portion that includes an image signal supply portion that supplies the image signals, and a video modulation portion that modulates the image signals for 60 Hz into the image signals for 120 Hz or 240 Hz; and a storing portion that stores the first method.

5. A method of driving a liquid crystal display device, comprising:

comparing differences of gray levels between image signals corresponding to red, green, and blue sub-pixels of a pixel with a first threshold value through a timing control portion;

comparing differences of gray levels between the image signals corresponding to the red, green, and blue sub-pixels of the pixel and a neighboring pixel with a second threshold value through the timing control portion;

judging a type of the image signals through the timing control portion according to a comparison result;

supplying from the timing control portion a data control signal and RGB data signals to a data driving portion and a gate control signal to a gate driving portion according to the type of the image signals;

supplying from the gate and the data driving portions gate and data signals, respectively, to a liquid crystal panel; and displaying an image using the gate and the data signals through the liquid crystal panel, wherein the timing control portion judges that the type of the image signals is a first or a second pattern, and determines to display the first or the second pattern in a first or a second driving method, and wherein when the red, green and blue sub-pixels of the neighboring pixels are Rn−1, Gn−1, and Bn−1, and Rn, Gn, and Bn, respectively, the pattern recognition portion judges as the first pattern the type of the image signals that meet a first condition ([|gray level of (Rn)−gray level of (Gn)|≤first threshold value] & [|gray level of (Gn)−gray level of (Bn)|≤first threshold value] & [|gray level of (Bn)−gray level of (Rn)|≤first threshold value]), and a second condition ([|gray level of (Rn−1)−gray level of (Rn)|≥second threshold value] & [|gray level of (Gn−1)−gray level of (Gn)|≥second threshold value] & [|gray level of (Bn−1)−gray level of (Bn)|≥second threshold value]), and judges as the second pattern the type of the image signals that do not meet the first and the second conditions.

6. The method according to claim 5, wherein the image signal is represented in 8 or 10-bit digital code, and the timing control portion compares the differences of gray level with respect to upper 6 or 8 bits of the image signal with the respective first and second threshold values.

* * * * *